US007243579B2

(12) United States Patent
Hennessey et al.

(10) Patent No.: US 7,243,579 B2
(45) Date of Patent: Jul. 17, 2007

(54) UNIVERSAL CAP TOOL/TOOL HOLDER

(75) Inventors: Frank Hennessey, Harwood Heights, IL (US); Dennis Jarnecke, River Forest, IL (US); John Steven Roxworthy, Chicago, IL (US); Angie Wood, Harwood Heights, IL (US)

(73) Assignee: Gas Technology Institute, Des Plaines, IL (US)

( * ) Notice: Subject to any disclaimer, the term of this patent is extended or adjusted under 35 U.S.C. 154(b) by 390 days.

(21) Appl. No.: 11/033,582

(22) Filed: Jan. 12, 2005

(65) Prior Publication Data

US 2006/0150778 A1 Jul. 13, 2006

(51) Int. Cl.
*B25B 13/06* (2006.01)
*B25B 13/48* (2006.01)
*B25B 13/58* (2006.01)

(52) U.S. Cl. ..... 81/125; 81/3.4; 81/185; 81/64

(58) Field of Classification Search ..... 81/125, 81/124.6, 124.3, DIG. 11, 185, 180.1, 121.1, 81/3.4, 3.41, 451, 452, 53.11, 53.12, 64; 294/19.1, 19.2; 279/102, 152
See application file for complete search history.

(56) References Cited

U.S. PATENT DOCUMENTS

| | | | | | |
|---|---|---|---|---|---|
| 2,337,368 | A | * | 12/1943 | Bohler | 81/185 |
| 2,709,907 | A | * | 6/1955 | Robertson et al. | 81/125 |
| 2,833,548 | A | * | 5/1958 | Clark | 279/102 |
| 2,985,045 | A | * | 5/1961 | Grasty et al. | 81/3.4 |
| 3,433,108 | A | * | 3/1969 | Ondeck | 81/124.6 |
| 3,678,789 | A | * | 7/1972 | Wilson | 81/64 |
| 3,834,253 | A | * | 9/1974 | Carr | 81/125 |
| 4,526,072 | A | * | 7/1985 | Manhoff, Jr. | 81/451 |
| 4,760,763 | A | * | 8/1988 | Trick et al. | 81/3.09 |
| 4,840,094 | A | * | 6/1989 | Macor | 81/185 |

* cited by examiner

*Primary Examiner*—D. S. Meislin
(74) *Attorney, Agent, or Firm*—Mark E. Fejer

(57) ABSTRACT

An apparatus for facilitating the use of tools on underground pipeline systems including a socket having a polygonal open end, a pliable socket insert having a polygonal outer circumference corresponding to the polygonal socket opening adapted to fit snugly into the polygonal opening and flush with the open end of the socket and a locking device by which the socket insert is maintained within the socket during use. The socket insert is provided with a plurality of pliant inwardly extending projections which deform to the size and geometry of the tool to be employed when the socket is pressed onto the tool.

19 Claims, 8 Drawing Sheets

UNIVERSAL CAP TOOL/TOOL HOLDER

BACKGROUND OF THE INVENTION

1. Field of the Invention

This invention relates to an apparatus for facilitating the use of tools, such as tools for the removal and installation of tee caps, couplings and the like on underground pipeline systems, and tools for performing other operations, such as surface preparations including cleaning and beveling of the ends of plastic pipe prior to the insertion of a coupling or end cap, on underground pipeline systems. More particularly, this invention relates to an apparatus for facilitating the use of tools in performing operations on underground pipeline systems in which visibility and access to the underground pipeline systems are limited.

2. Description of Related Art

Gas utilities perform several operations on underground pipeline systems including the removal and installation of tee caps, insertion of couplings and pipeline surface preparations. When performed through a traditional bell hole, the performance of these operations generally does not represent a significant problem. For example, when removing and installing tee caps, workers are able to easily determine the cap size, type of cap and other physical attributes of the cap and are able to access the cap with cap-specific tools/accessories or with common adjustable tools. However, performance of these operations through a keyhole is substantially more problematic.

"Keyholing" and "potholing" refers to the excavation of a hole to access or repair utilities. Potholing and keyholing are preferred over other techniques such as digging shovels, backhoes, and the like which often result in damage to the utilities and the corresponding demand for expensive repair and reconstruction. In addition to the increased costs associated with damage repair and increased labor costs associated with digging, such damage may present danger to workers or others in the immediate vicinity of the excavation.

Typically, a keyhole is 12-18 inches in diameter and up to about ten feet in depth and visibility down the keyhole is limited, thereby precluding the use of conventional tools to access the utility. For removal and installation of tee caps, limited visibility makes it very difficult to determine the type of cap, the cap size and whether or not the workers have the proper equipment to handle the cap. In addition, tee cap designs are not standardized. Thus, it is extremely difficult to identify every variation in cap design and size and to have specific tools and accessories for each design and size. Frequently, the type of cap is not even known until it is unearthed. It is, thus, apparent that for a crew truck to be equipped for every possible cap design would require an excessive amount of tools and accessories. Accordingly, a tool for removal and installation of tee caps in keyholes, or even in conventional bell holes, which is able to accommodate a majority, if not all, of the various cap designs and sizes would be highly desirable.

Similar considerations exist in connection with the performance of other operations and procedures on the underground pipeline through keyholes and potholes as well.

SUMMARY OF THE INVENTION

Accordingly, it is one object of this invention to provide an apparatus for facilitating the use of tools on underground pipeline systems.

It is one object of this invention to provide an apparatus for removal and installation of tee caps from underground pipeline systems.

It is one object of this invention to provide an apparatus for facilitating the use of tools on underground pipeline systems where access to the underground pipeline system is by way of keyholes or potholes.

It is yet another object of this invention to provide an apparatus for removal and installation of tee caps from underground pipeline systems that is suitable for use with several designs, sizes and shapes of tee caps.

It is yet another object of this invention to provide an apparatus for facilitating the use of tools on underground pipeline systems through keyholes or potholes which substantially precludes dropping of the tools into the keyhole or pothole during use.

It is yet another object of this invention to provide an apparatus for removal and installation of tee caps from underground pipeline systems which substantially precludes dropping of the tee cap into the keyhole during removal or installation.

It is still a further object of this invention to provide an apparatus for facilitating the use of tools on underground pipeline systems through keyholes or potholes which reduces the amount of time required to perform desired operations and procedures on the underground pipeline system.

It is another object of this invention to provide an apparatus for removal and installation of tee caps on underground pipeline systems which reduces the likelihood of damage to the tee caps.

It is still a further object of this invention to provide an apparatus for removal and installation of tee caps on underground pipeline systems which, in addition to conserving space on crew trucks, also reduces the cost to equip the crew trucks.

These and other objects of this invention are addressed by an apparatus for facilitating the use of tools on underground pipeline systems comprising a holder suitable for holding tee caps, fittings and tools, hereinafter referred to as a cap/tool holder having a cylindrical body closed off on a first end by an end wall and having an open second end, which open second end forms a polygonal opening. The end wall forms an end wall opening adapted to lockingly connect to a rotatable shaft. The apparatus further comprises a pliable donut-shaped cap/tool holder insert having a polygonal outer circumference corresponding to the polygonal opening of the cylindrical body. The cap/tool holder insert is sized to fit snugly into the polygonal opening and flush with the second end. The cap/tool holder insert further comprises a plurality of projections or finger-like extensions extending from the inner circumferential surface of the cap/tool holder insert into the centralized space formed by the cap/tool holder insert, which projections or finger-like extensions form an opening substantially corresponding to the shape of the tee cap, fitting, or tool being used. Finally, locking means are provided for securing the cap/tool holder insert within the cylindrical body.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

The invention disclosed herein is an apparatus for facilitating the use of tools for performing certain operations and procedures on underground pipeline systems including the removal and installation of tee caps and is particularly suitable for use in accessing the underground pipeline systems through keyhole- or pothole-type excavations. In general terms, the apparatus employs a deformable material, referred to herein as a cap/tool holder insert or socket insert, contained within a rigid structural material, referred to herein as a cap/tool holder or socket, to apply the torque and/or compression required to perform the tee cap removal or installation or other desired operation. Torque is applied through a rotating shaft, such as a socket drive. The cap/tool holder geometry insures that the cap/tool holder insert remains stationary in the cap/tool holder while undergoing an applied torque. A locking mechanism retains the cap/tool holder insert in the cap/tool holder and left hand or right hand torque can be applied simply by reversing the orientation of the cap/tool holder insert in the cap/tool holder. The cap/tool holder may be utilized to engage various cap/tool holder inserts and it even may be used by itself to engage or hold tools or components that fit or can be adapted to the cap/tool holder.

Figure 1:
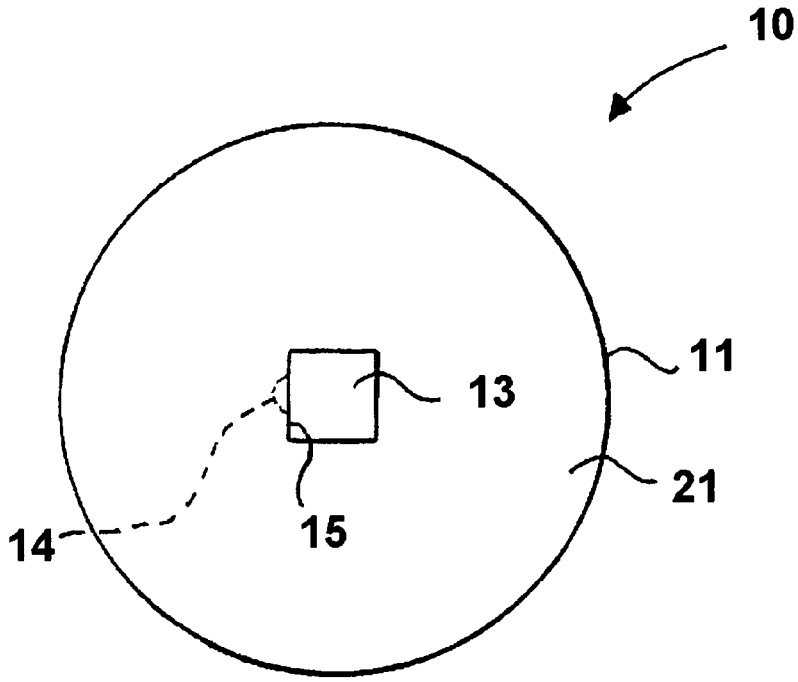
FIG. 1 is a plan view of the top of a cap/tool holder in accordance with one embodiment of this invention.
Figure 2:
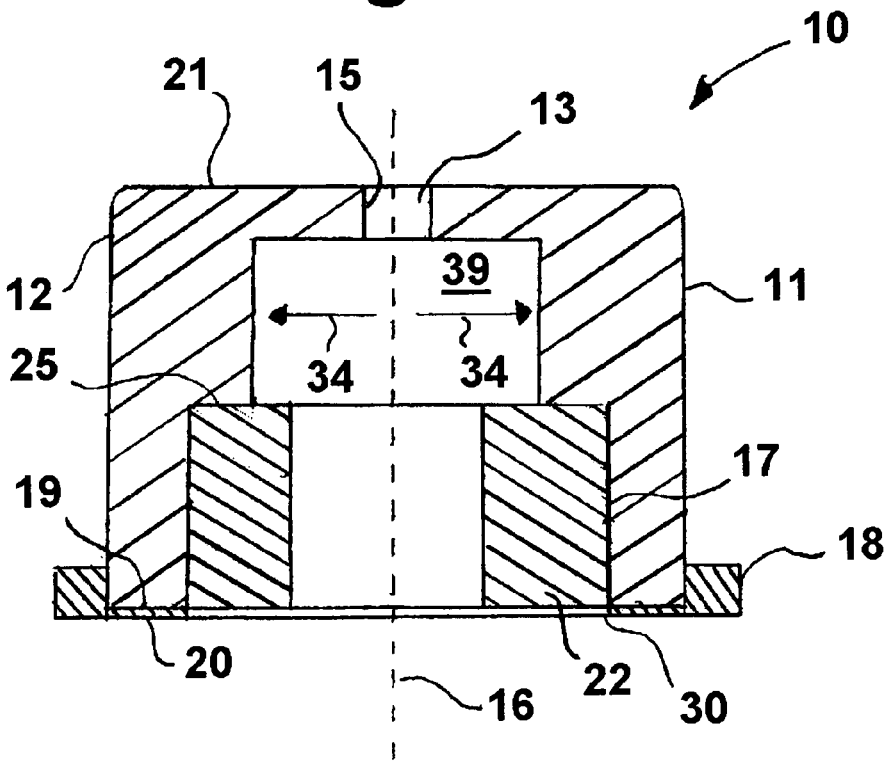
FIG. 2 is a lateral cross-sectional view of a cap/tool holder in accordance with one embodiment of this invention.
Figure 9:
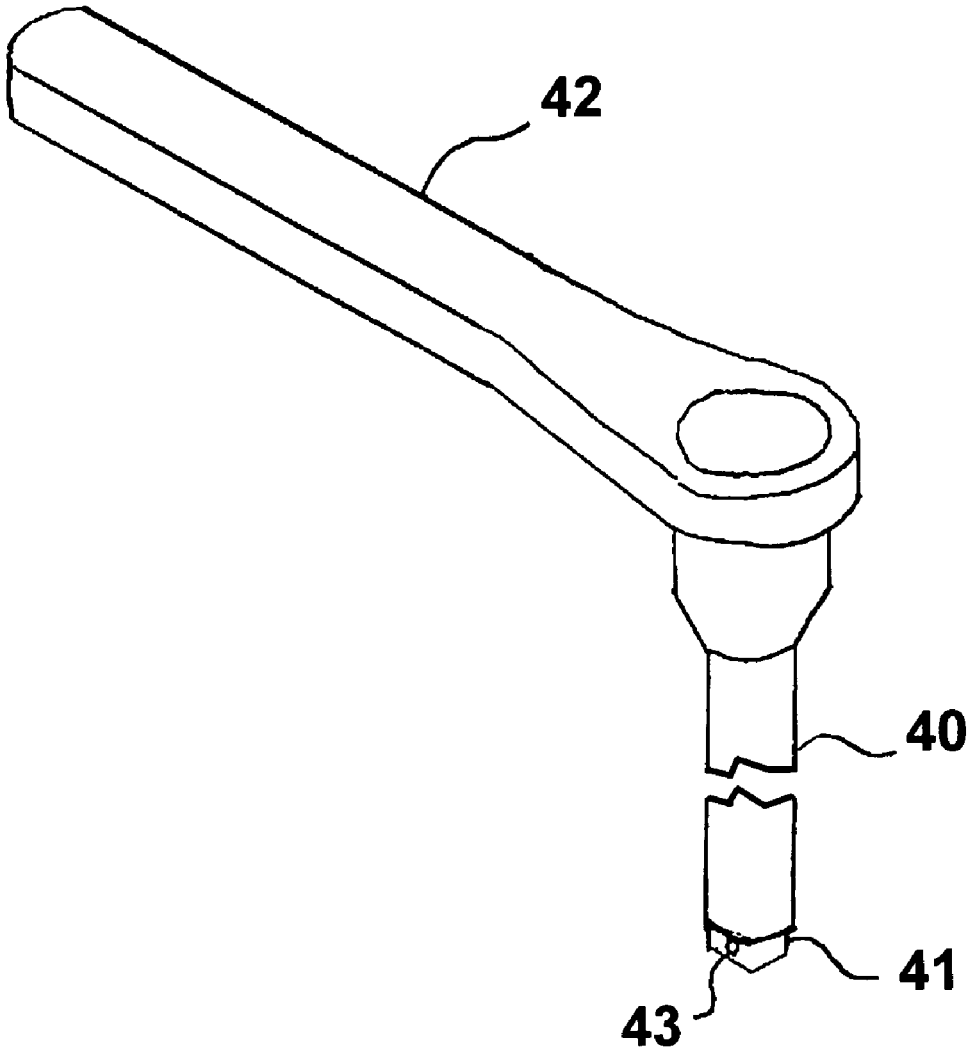
FIG. 9 is a perspective view of a rotatable shaft and handle suitable for rotating the cap/tool holder during removal and installation of tee caps and manipulation of other tools.

FIG. 1 shows a top view of the cap/tool holder or socket 10 in accordance with one embodiment, which comprises a cylindrical body 11 and an end wall 21, more clearly shown in FIG. 2. End wall 21 forms an end wall opening 13 which is adapted to lockingly connect to a rotatable shaft 40, rotated by means of a handle 42, as shown in FIG. 9. In accordance with one preferred embodiment of this invention, end wall opening 13 has a generally rectangular shape. In accordance with another preferred embodiment of this invention, side wall 15 of end wall opening 13 forms a notch 14 suitable for engagement with the rectangular end 41 and detent 43 of rotatable shaft 40.

Figure 5:
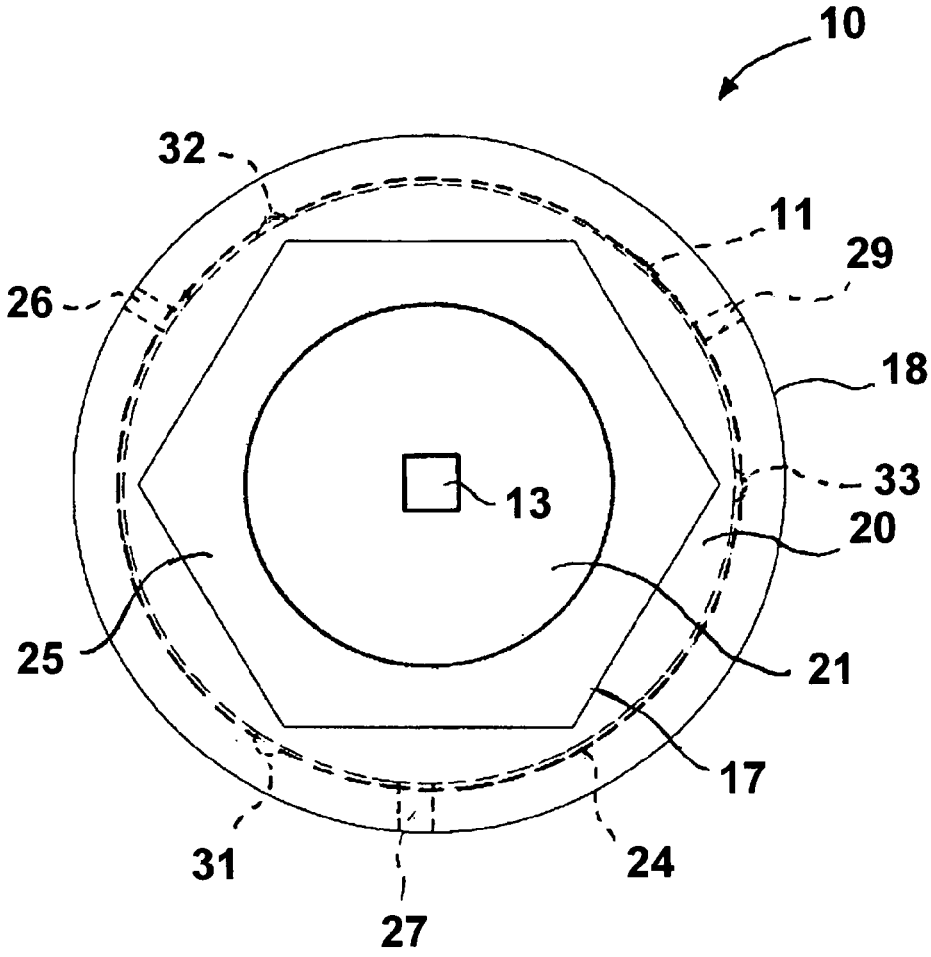
FIG. 5 is a view of the bottom of a cap/tool holder in accordance with one embodiment of this invention in an unlocked condition and without the cap/tool holder insert.
Figure 7:
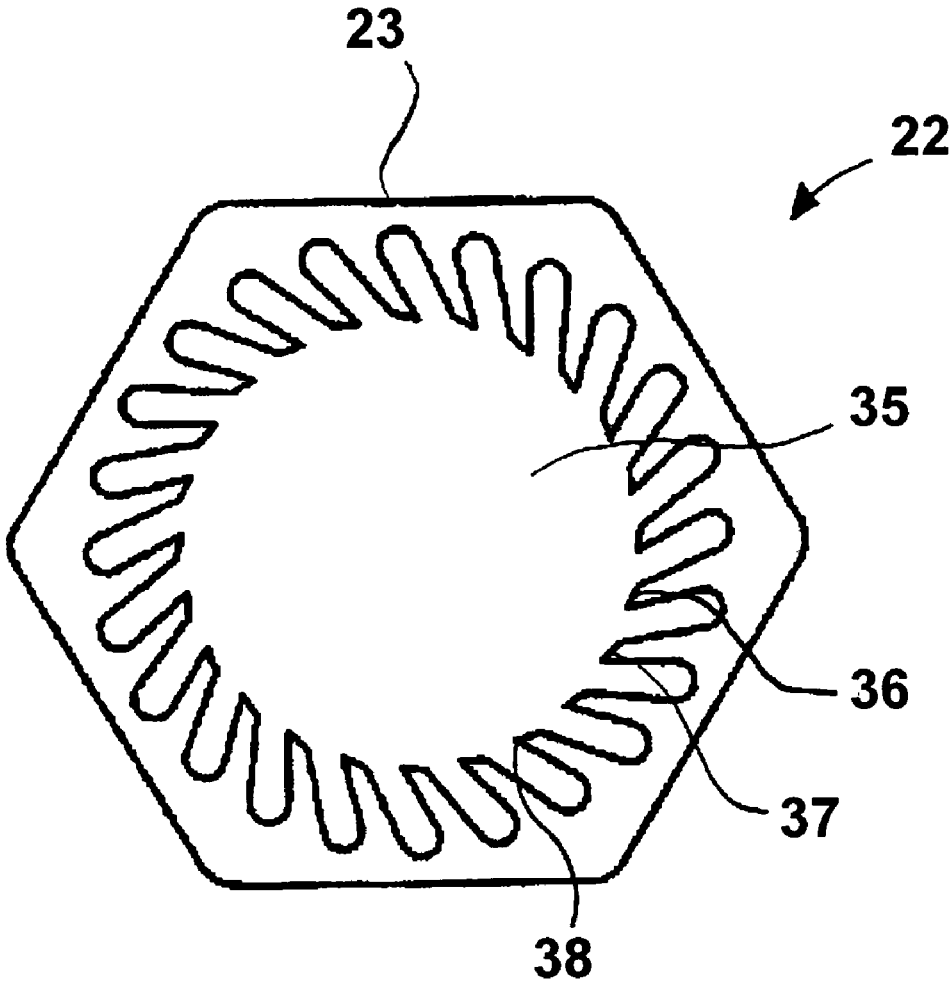
FIG. 7 is a top view of a cap/tool holder insert in accordance with one embodiment of this invention.
Figure 8:
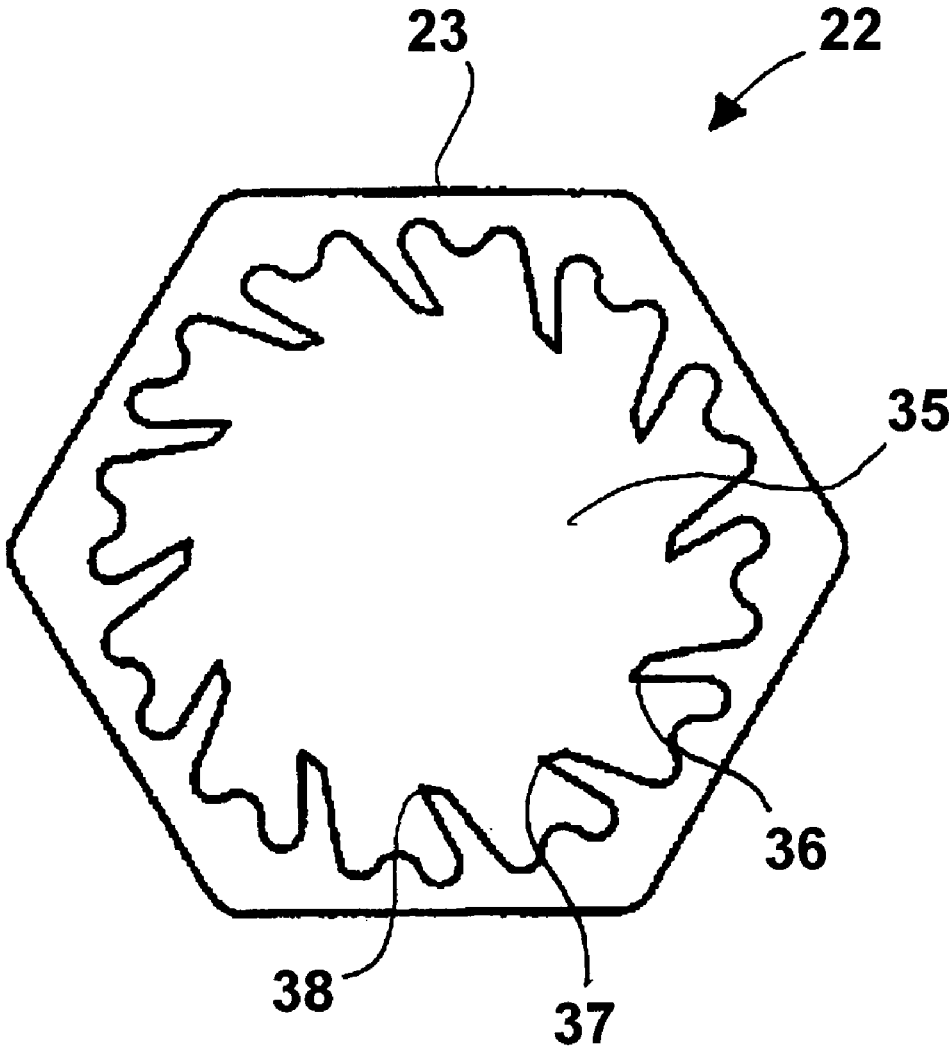
FIG. 8 is a top view of another cap/tool holder insert in accordance with one embodiment of this invention.

As shown in FIG. 2, cylindrical body 11 comprises a first end 12 which is closed off by end wall 21 and an open second end 19 which forms a polygonal opening 17, as shown more clearly in FIG. 5. A pliable donut-shaped cap/tool holder insert 22 having a polygonal outer circumference 23, as shown in FIGS. 7 and 8, corresponding to polygonal opening 17 is disposed within polygonal opening 17. Cap/tool holder insert 22 is sized to fit snugly into polygonal opening 17 and to be flush with the open second end 19. To prevent cap/tool holder insert 22 from inadvertently coming out of cylindrical body 11 during use, cap/tool holder 10 further comprises locking means for securing cap/tool holder insert 22 within the open second end 19 of cylindrical body 11.

Figure 6:
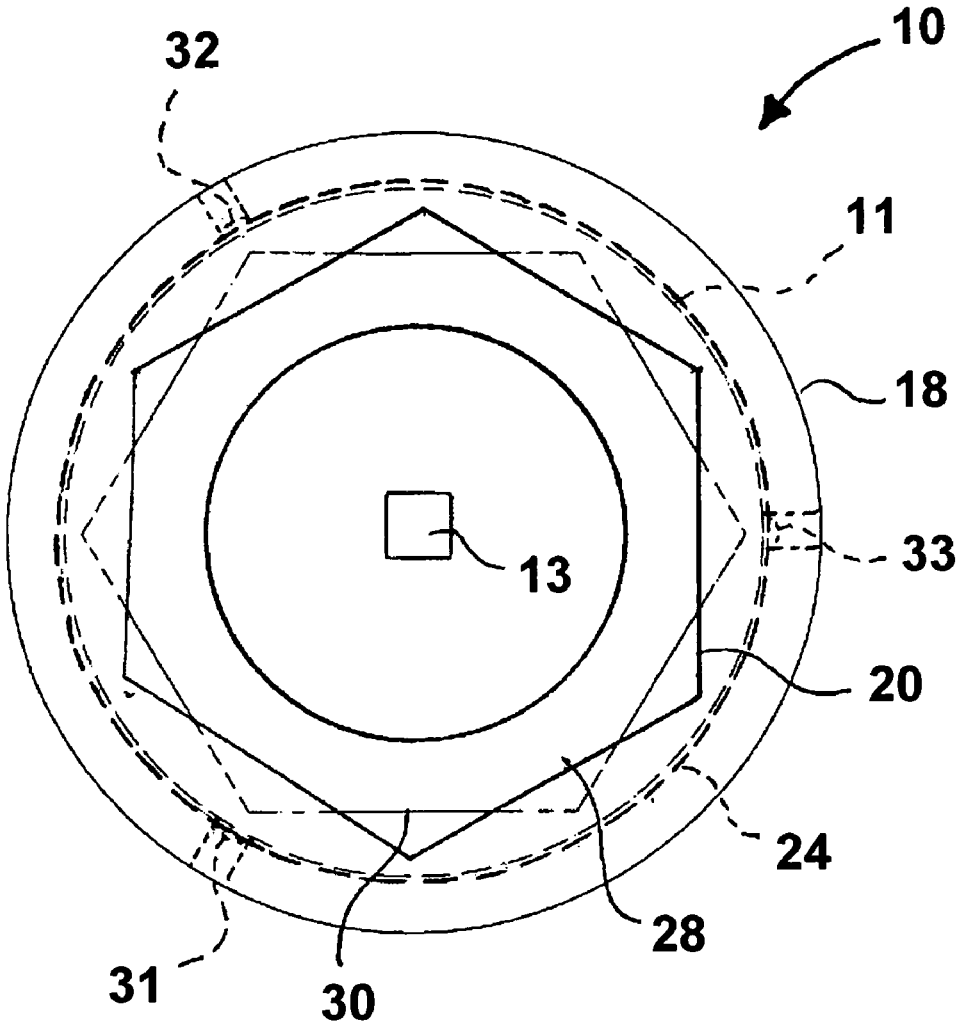
FIG. 6 is a view of the bottom of a cap/tool holder in accordance with one embodiment of this invention in a locked condition and without the cap/tool holder insert.

In accordance with one preferred embodiment of this invention, the locking means comprises a rotatable ring 18 secured around the second end 19 of cylindrical body 11, which ring is rotatable around a longitudinal axis 16 of the cylindrical body. Rotatable ring 18 comprises a lip 20 extending over the second end 19 of cylindrical body 11, which lip forms a polygonal lip opening 28 corresponding to polygonal opening 17. Rotatable ring 18 is rotatable between an open, or non-locking, position in which polygonal lip opening 28 is aligned with polygonal opening 17, as shown in FIG. 5, thereby enabling the insertion and removal of cap/tool holder insert 22, and a locking position, as shown in FIG. 6, in which polygonal lip opening 28 is offset with respect to polygonal opening 17, thereby precluding the removal of cap/tool holder insert 22 during use of the cap/tool holder.

To prevent inadvertent or unintentional rotation of rotatable ring 18, in accordance with one embodiment of this invention, ring 18 comprises an inner wall 24 which forms at least one ring notch 26, 27, 29 adapted to engage a detent 31, 32, 33 disposed within an outer wall of cylindrical body 11 upon rotation of the ring to the locking position.

Figure 3:
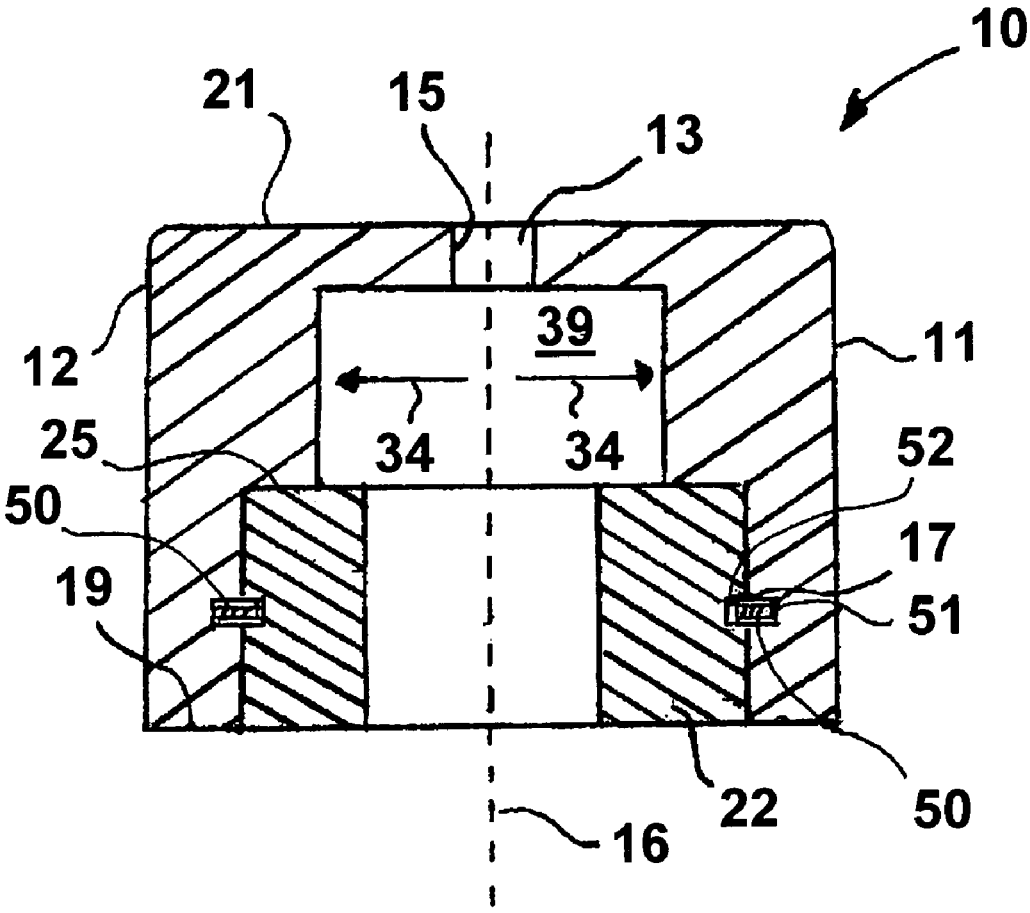
FIG. 3 is a lateral cross-sectional view of a cap/tool holder in accordance with one embodiment of this invention.
Figure 4:
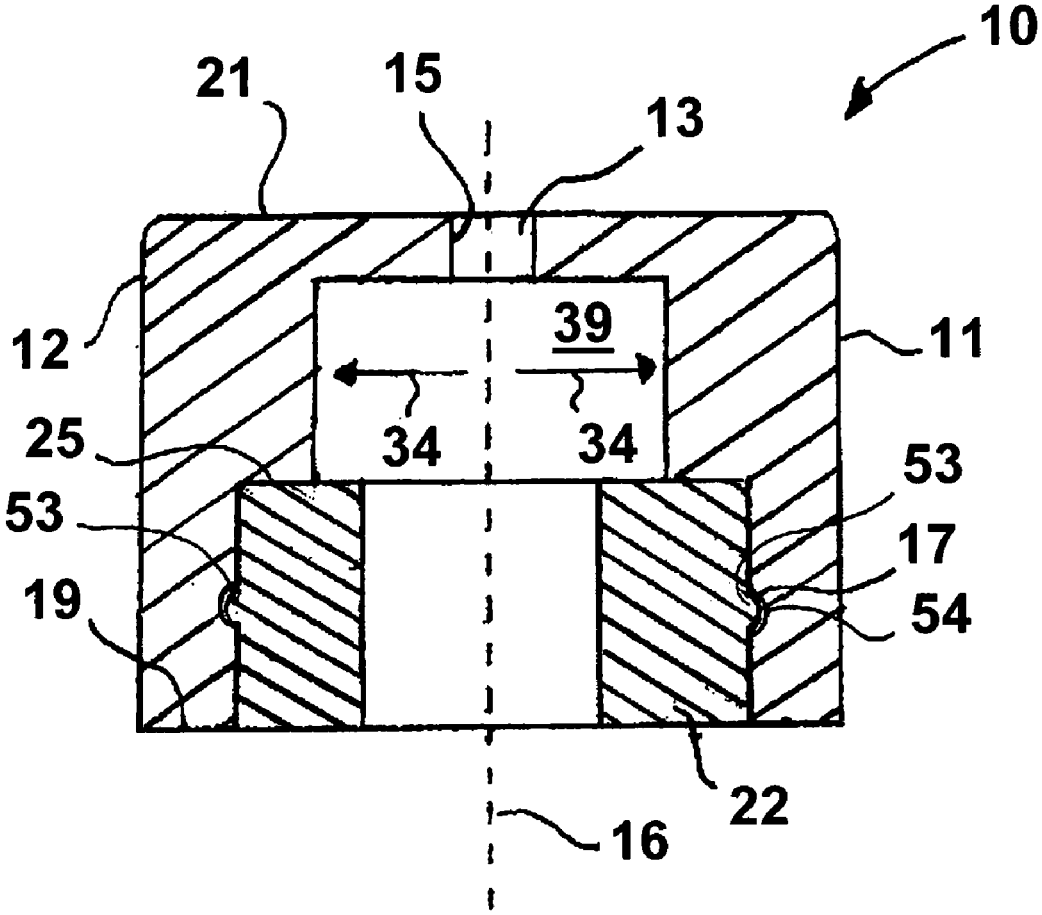
FIG. 4 is a lateral cross-sectional view of a cap/tool holder in accordance with one embodiment of this invention.

It will be apparent to those skilled in the art that there may be other locking means for securing cap/tool holder insert 22 within the open second end 19 of cylindrical body 11, and such other locking means are deemed to be within the scope of this invention. By way of example, in accordance with one embodiment of this invention as shown in FIG. 3, one or more dowel pins 50 may be disposed within one or more openings 51 of the wall forming the polygonal opening 17 of cylindrical body 11, which dowel pins engage corresponding openings or depressions 52 in cap/tool holder insert 22 when disposed within open second end 19 of cylindrical body 11. In accordance with another embodiment of this invention as shown in FIG. 4, cap/tool holder insert 22 comprises at least one outwardly extending peripheral projection 53, such as a bead, which projection corresponds to a depression 54 formed on the surface of the wall forming polygonal opening 17, whereby, upon insertion of a cap or tool into the cap/tool holder insert, the circumferential wall of cap/tool holder insert 22 is forced outwardly, resulting in engagement of the peripheral projection with the depression.

As shown in FIG. 2, the longitudinal thickness of cap/tool holder insert 22 corresponds to the distance from second end 19 which the polygonal shape of polygonal opening 17 extends toward end wall 21. In accordance with one particularly preferred embodiment of this invention, cylindrical body 11 has a reduced inside diameter as indicated by arrows 34 beginning at a distance from second end 19 corresponding to the longitudinal thickness of cap/tool holder insert 22 and extending to end wall 21, the effect of which is the formation of a shoulder 25 against which cap/tool holder insert 22 abuts, resulting in turn in the formation of an open space 39 to accommodate tee caps having less than a uniform diameter for its entire length or tee caps with external protrusions extending from the cap top.

As shown in FIGS. 7 and 8, cap/tool holder insert 22 comprises a patterned array of projections or "teeth" 36, 37, 38, which extend into the central space 35 formed by the donut-shaped cap/tool holder insert. The projections engage the ribs or other geometrical features on the outer diameter of a tee cap to be removed or installed. Pressing the cap/tool holder insert over a tee cap causes the projections to deform to the cap size and engage the cap geometry. This allows one cap/tool holder insert to conform to several tee cap sizes and designs. Compression caused by the deformation of the projections on the outer diameter of the tee cap also helps to retain the cap in the cap/tool holder, thereby helping to prevent the cap from dropping out of the cap/tool holder. This same mechanism may be applied to engage, hold, or grip, tools, fittings and the like.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. An apparatus for facilitating the use of tools on underground pipeline systems comprising:

a cap/tool holder having a cylindrical body closed off on a first end by an end wall, said end wall forming an end wall opening adapted to lockingly connect to a rotatable shaft, and said cylindrical body having an open second end, said open second end forming a polygonal opening;

a pliable donut-shaped cap/tool holder insert having a polygonal outer circumference corresponding to said polygonal opening adapted to fit snugly into said polygonal opening and flush with said second end;

said cap/tool holder insert further comprising a plurality of projections extending from an inner circumferential surface of said cap/tool holder insert into a centralized space formed by said cap/tool holder insert; and locking means for securing said cap/tool holder insert within said cylindrical body.

2. An apparatus in accordance with claim 1, wherein said end wall opening has a generally rectangular shape.

3. An apparatus in accordance with claim 2, wherein a side wall of said end wall opening forms a notch.

4. An apparatus in accordance with claim 1, wherein said locking means comprises a rotatable ring secured around said second end of said cylindrical body, said ring rotatable around a longitudinal axis of said cylindrical body.

5. An apparatus in accordance with claim 4, wherein said ring comprises a lip extending over said second end of said cylindrical body and forming a polygonal lip opening corresponding to said polygonal opening.

6. An apparatus in accordance with claim 5, wherein said ring is rotatable between an open position in which position said polygonal lip opening is aligned with said polygonal opening and a locking position in which position said polygonal lip opening is offset with respect to said polygonal opening.

7. An apparatus in accordance with claim 6, wherein an inner wall of said ring forms at least one ring notch adapted to engage a detent disposed within an outer wall of said cylindrical body upon rotation of said ring to said locking position.

8. An apparatus in accordance with claim 1, wherein said polygonal opening has a longitudinal depth corresponding to a longitudinal thickness of said cap/tool holder insert.

9. An apparatus in accordance with claim 8, wherein said cylindrical body has a reduced inside diameter beginning at a distance from said second end corresponding to said longitudinal thickness of said cap/tool holder insert and extending to said end wall.

10. An apparatus for facilitating the use of tools on underground pipeline systems comprising:

a cap/tool holder having a cylindrical body closed off on a first end by an end wall, said end wall forming an end wall opening adapted to lockingly connect to a rotatable shaft;

a pliable donut-shaped polygonal cap/tool holder insert having a polygonal circumference adapted to fit into a second end of said cylindrical body, said second end of said cylindrical body having a polygonal interior surface corresponding to said polygonal circumference of said cap/tool holder insert sized to snugly accommodate said cap/tool holder insert;

said cap/tool holder insert further comprising a plurality of pliable projections extending from an inner circumferential surface of said cap/tool holder insert into a centralized space formed by said cap/tool holder insert; and locking means for securing said cap/tool holder insert within said cylindrical body.

11. An apparatus in accordance with claim 10, wherein said end wall opening has a generally rectangular shape.

12. An apparatus in accordance with claim 11, wherein a side wall of said end wall opening forms a notch.

13. An apparatus in accordance with claim 10, wherein said locking means comprises a rotatable ring secured around said second end of said cylindrical body, said ring rotatable around a longitudinal axis of said cylindrical body between an open position and a locking position.

14. An apparatus in accordance with claim 13, wherein said ring comprises a lip extending over said second end, said lip forming a polygonal lip opening corresponding to said polygonal circumference of said cap/tool holder insert.

15. An apparatus in accordance with claim 14, wherein an inner wall of said ring forms at least one ring notch adapted to engage a detent disposed within an outer wall of said cylindrical body upon rotation of said ring to said locking position.

16. An apparatus in accordance with claim 10, wherein said polygonal interior surface extends in a longitudinal direction from said second end for a distance corresponding to a longitudinal thickness of said cap/tool holder insert.

17. An apparatus in accordance with claim 16, wherein said cylindrical body has a reduced inside diameter beginning at said distance corresponding to said longitudinal thickness of said cap/tool holder insert and extending to said end wall.

18. An apparatus in accordance with claim 10, wherein said locking means comprises at least one outwardly extending projection disposed on said polygonal circumference of said cap/tool holder insert, said projection adapted to fit within a corresponding depression formed by said polygonal interior surface of said cylindrical body upon insertion of one of a cap, a tool and a fitting into said cap/tool holder insert.

19. An apparatus in accordance with claim 10, wherein said locking means comprises at least one dowel pin disposed within a dowel pin opening formed by said polygonal interior surface of said cylindrical body, said at least one dowel pin adapted to engage at least one corresponding opening formed by said polygonal circumference of said cap/tool holder insert.

* * * * *